US005316435A

United States Patent [19]

Mozingo

[11] Patent Number: 5,316,435

[45] Date of Patent: May 31, 1994

[54] THREE FUNCTION CONTROL SYSTEM

[75] Inventor: Robert E. Mozingo, Burlington, Iowa

[73] Assignee: Case Corporation, Racine, Wis.

[21] Appl. No.: 921,855

[22] Filed: Jul. 29, 1992

[51] Int. Cl.[5] ..... E02F 3/36

[52] U.S. Cl. ..... 414/685; 74/471 XY; 74/529

[58] Field of Search ..... 414/685, 694, 4; 74/471 XY, 529, 538; 137/636.3, 636.2; 244/234

[56] References Cited

U.S. PATENT DOCUMENTS 3,741,031 6/1973 Schwerdtfeger .
3,831,633 8/1974 Comer .
3,854,380 12/1974 Casey .
3,897,805 8/1975 Casey .
3,943,791 3/1976 Casey .
4,019,401 4/1977 Drone .
4,028,958 6/1977 Schuermann et al. .
4,187,737 2/1980 Mori et al. .
4,523,488 6/1985 Ahrendt .
4,667,909 5/1987 Curci ..... 74/471 XY X
4,736,647 4/1988 Shimoie et al. .
4,938,091 7/1990 Waggoner et al. .
4,978,273 12/1990 Radke et al. .
5,112,184 5/1992 Tapper et al. ..... 74/471 XY X
5,142,931 9/1992 Menahem ..... 244/234 X

*Primary Examiner*—Michael S. Huppert
*Assistant Examiner*—Donald W. Underwood
*Attorney, Agent, or Firm*—Rudnick & Wolfe

[57] ABSTRACT

A three function control system for independently or conjointly controlling three separate hydraulic valves through manipulation of a single control lever. The control system basically includes a single vertically elongated control lever mounted for manipulation through first and second control arcs and has a handle assembly carried at a free upper end of the control lever to facilitate one-handed control over the three valves. First and second linkage assemblies translate arcuate movements of the control lever through the first and second arcs, respectively, into regulatory operations of a first and second hydraulic valves, respectively. A third linkage assembly transmutes twisting movements of the control lever into regulatory movements for the third valve thereby facilitating single-handed control over all three hydraulic valves. A locking mechanism releasably holds the handle assembly to inhibit inadvertent operations of the valves.

14 Claims, 4 Drawing Sheets 323
362
356
357
359
388
384
390
392
382
380
386
361
44
42
46
48
344
336
366
339
342
326
372
338
340
358
322
320
360
350
364
352

THREE FUNCTION CONTROL SYSTEM

FIELD OF THE INVENTION

The present invention relates to a control system for regulating operation of three separate hydraulic control valves through manipulation of a single control lever.

BACKGROUND OF THE INVENTION

Off-highway implements, such as front-end loaders and the like, are typically provided with a loader mechanism at one end thereof. A conventional loader mechanism includes a working tool such as a bucket or the like pivotally connected to a frame of the implement by longitudinally extending loader arms. A series of hydraulic actuators, usually in the form of double-acting hydraulic cylinders, are connected to a hydraulic system of the implement for effecting various loader functions. Hydraulic actuators are used to elevationally position the bucket or tool by raising and lowering the loader arms. Hydraulic actuators are likewise used to control the roll or pivotal movement of the bucket relative to the loader arms. Many loader mechanisms further incorporate a device such as a clam shell bucket which utilizes hydraulic actuators to effect articulated movement of the clam shell bucket to effect a "grab" function.

Control over the various loader functions or work operations is conventionally achieved through manipulation of various control levers. Each control lever is connected to one or more control valves which, in turn, regulates hydraulic fluid flow between a pressurized hydraulic source on the implement and each of the actuators.

During operation of the implement, the loader mechanism can perform a single function, but usually at least two loader functions are effected simultaneously relative to each other. That is, while the loader arms are being elevationally adjusted, the pivotal position or roll of the bucket may likewise be adjusted. When the loader is equipped with a clam shell bucket, all three loader functions may be effected simultaneously to economize on operational time for the loader. As will be appreciated, controlling the implements direction and speed simultaneously with the raising, lowering, tilting, and articulating movements of the bucket of the loader mechanism through movement of a multiplicity of control levers can become a cumbersome task for anyone to perform successfully.

Thus, there is a need and a desire for a control system including a single control lever capable of effecting regulation of various loader functions either independently of one another or in unison with one another or, in any combination desired by the operator.

SUMMARY OF THE INVENTION

In view of the above, and in accordance with the present invention, there is provided a control system for independently or conjointly controlling three separate hydraulic valves. The control system includes a single vertically elongated control lever mounted for manipulation through first and second control arcs and having a handle assembly carried at a free upper end of the control lever to facilitate one-handed control over three functions of the control system. A first linkage assembly translates arcuate movements of the control lever through the first arc into regulatory movements of a first hydraulic valve thereby controlling a first loader function. A second linkage assembly translates arcuate movements of the control lever through the second control arc into regulatory movements of a second hydraulic valve thereby controlling a second loader function. A third linkage assembly is adapted to position a third hydraulic valve in response to twisting movements of the single handle thereby controlling a third motor function. Notably, the first, second, and third linkage assemblies are configured such that the various loader functions can be accomplished either independently or conjointly relative, to each other through various movements of the handle assembly mounted on the control lever thereby facilitating single-handed control over all three valves and thereby functions of the control system.

A mounting mechanism arranged between opposite ends of the control lever allows for arcuate movements of the control lever about first and second pivot axes. The first, second, and third linkage assemblies each include an actuator disposed in relation to each other whereby manipulation of the control lever about the first and second axes independently or conjointly controls the first and second hydraulic valves while twisting movement of the handle assembly controls the third hydraulic valve.

In a preferred form of the invention, the first linkage assembly includes a rockshaft disposed to pivot about an axis spaced from and extending parallel to the first pivot axis of the control lever. The actuator of the first linkage assembly moves the rockshaft in response to manipulation of the control lever through the first control arc thereby resulting in positioning of the respective hydraulic valve. Movement of the control lever through the second control arc results in substantially no movement of the rockshaft and thereby has no effect on the hydraulic valve associated therewith. Preferably, suitable ball joints disposed between the actuator, the control lever, and the rockshaft facilitates substantially universal movement therebetween.

The actuator for the second linkage assembly is adapted for oscillatory movements about a reference line axially aligned with and extending generally parallel to the second pivot axis of the control lever. The actuator includes a radial extension movable in response to manipulation of the control lever through the second control arc for positioning the second hydraulic valve in response to movement of the control lever in the second arc. Movement of the control lever through the first control arc results in substantially no movement of the actuator or the radial extension of the second linkage assembly and thereby has substantially no effect on positioning of the second hydraulic valve. Preferably, the actuator of the second linkage assembly is configured as a control rod mounted for rotation between a pair of supports which inhibit endwise movement of the control rod between the supports.

The third linkage assembly includes a bell crank lever connected to the third hydraulic valve. The bell crank lever of the third linkage assembly is mounted for pivotal movement about an axis in response to movement of the third assembly actuator thereby controlling a third function. The actuator of the third linkage assembly extends between the handle assembly and the bell crank lever such that twisting manipulation of the handle assembly pivots the bell crank lever and thereby controls the third loader function. Movements of the control lever through either the first or second control arcs has substantially no effect on movement of the bell crank lever or the third function. To economize on the number of parts within the control system, in a preferred form of the invention, the bell crank lever is pivotally mounted for rotation about the fixed axis of the rockshaft of the first linkage assembly.

The handle assembly includes a handle which is contoured to fit the hand of the operator to facilitate twisting movements thereof as well as accommodating movements of the control lever in the first and second directions. In a preferred form of the invention, the handle assembly further includes a lock apparatus for releasably locking the handle to the control lever to inhibit inadvertent twisting movements of the handle during movement of the control lever.

The three function control system of the present invention is particularly useful for independently or conjointly controlling three different operator functions of a front-end loader, including a loader mechanism supported from a wheeled frame. As is conventional, the loader mechanism includes a pair of loader arms pivotally attached to the frame at one end thereof for movement about a generally horizontal axis. A loader bucket including a base member and a movable member is pivotally attached to the distal ends of the loader arms. The movable member of the loader bucket is adapted for articulated movement about a transversely extending axis between open and closed positions. The loader further includes a hydraulic system including a pressurized fluid source connected to first, second, and third hydraulic actuators for effecting various loader functions, including: elevating the bucket relative to the frame; pivoting the bucket relative to the loader arms; and articulately moving the movable member relative to the base member of the bucket to effect a "grab" function. As will be appreciated, the control system of the present invention is interposed between the power source and the hydraulic actuators for selectively controlling operation of the loader mechanism under the influence of the operator.

With the present invention, three different operative functions of the front end loader are controlled through a single control lever. Each operator function of the loader mechanism can be effected independently or conjointly relative to each other. The present invention relieves the cumbersome task of having to manipulate separate control levers to operate a loader mechanism having an operative auxiliary device such as a clam shell bucket for effecting a "grab" function of the loader mechanism. Another advantage of the present invention is the provision of a three function control system which is durable in construction, inexpensive to manufacture, offers substantially carefree maintenance, as well as being simple and effective in use.

These and other numerous features and advantages of the present invention will become readily apparent from the following detailed description, the accompanying drawings, and the appended claims.

DETAILED DESCRIPTION OF THE INVENTION

Figure 1:
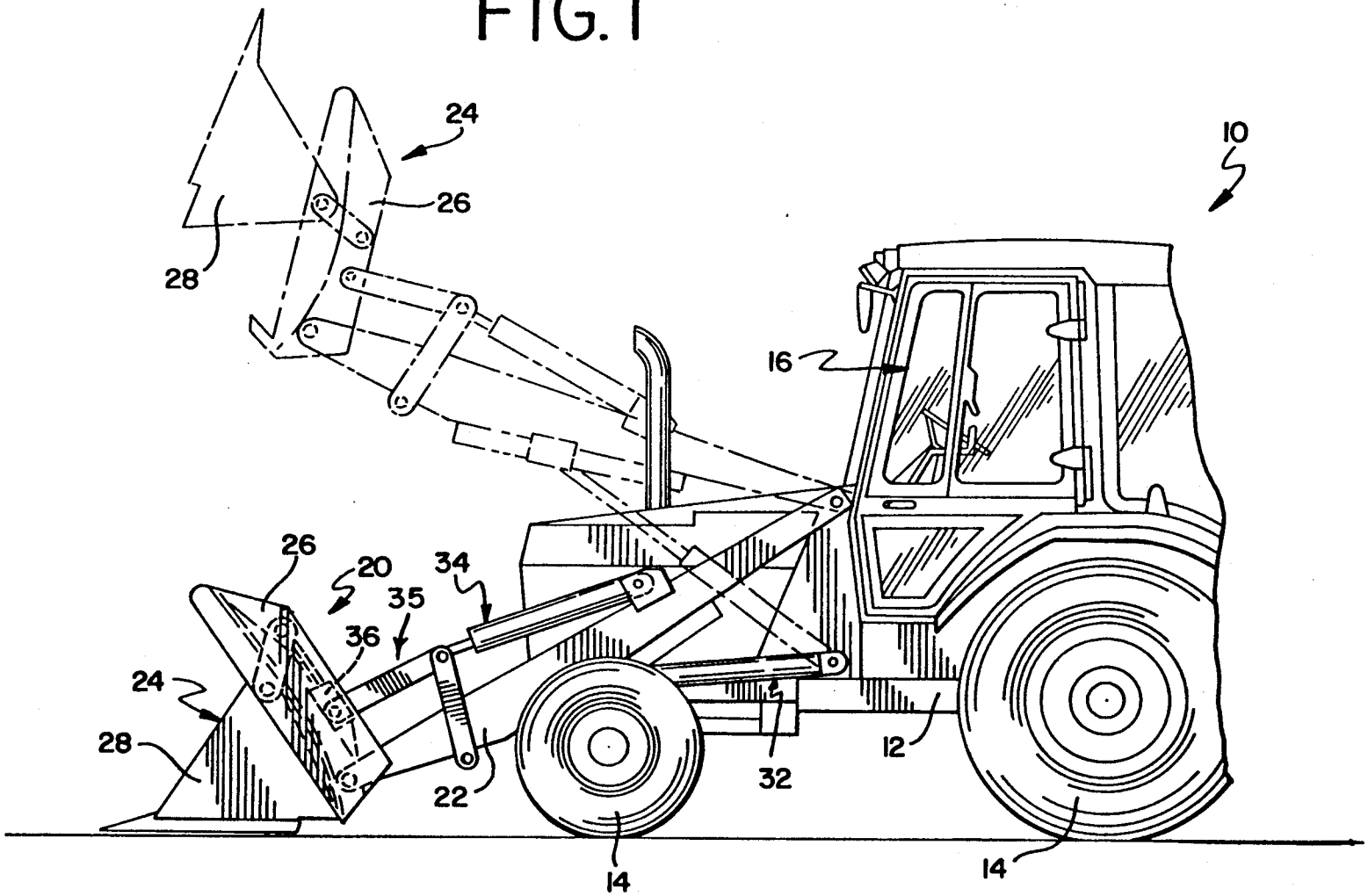
FIG. 1 is a side elevational view of an off-highway implement in the form of a front-end loader incorporating principles of the present invention.

While the present invention is susceptible of embodiment in various forms, there is shown in the drawings preferred embodiments of the invention which are hereinafter described, with the understanding that the disclosures which are presented are to be considered as exemplifications of the invention and are not intended to limit the invention to the specific embodiments illustrated.

Referring now to the drawings, wherein like reference numerals indicate like parts throughout the several views, FIG. 1 schematically shows an off-highway implement such as a front-end loader designated generally by reference numeral 10. Loader 10 includes a frame 12 provided with wheels 14 to permit mobile movement of the loader over the ground. Loader 10 further includes an operator station 16 in which various operative controls are conveniently accessible to permit the operator to control various loader functions. Although the control system of the present invention is described as being arranged on a front-end loader, the invention should not be so limited as it may be equally applied to other off-highway implements which would be facilitated by single lever three function control.

Loader 10 also includes a loader mechanism 20 supported from the frame for the handling of materials. As is conventional, loader mechanism 20 includes a pair of fore-and-aft extending loader arms 22 pivotally connected to the frame 12 for elevational movements about a generally horizontal axis. A working tool 24, such as a bucket, is pivotally connected between the distal ends of the arms 22 for pivotal rolling movements. In the illustrated embodiment, bucket 24 is capable of independent articulated movements such as shown in phantom lines in FIG. 1. Such a bucket typically includes a base member 26 connected to the loader arms 22 and a clam member 28 pivotally supported from the base member and movable relative thereto between open and closed positions to effect a "grab" function for the loader mechanism.

Loader 10 is further provided with a hydraulic system including a hydraulic fluid source (not shown) for providing pressurized hydraulic fluid to various hydraulic actuating components of loader 10. The hydraulic system includes a pair of hydraulic actuators 32 interconnected between frame 12 and loader arms 22 to elevationally position the bucket 24 relative to the frame 12. Similarly, a pair of hydraulic actuators 34 interconnect loader arms 22 through a linkage 35 to the bucket 24 to effect pivotal or rolling movement of the bucket relative to the loader arms 22. The hydraulic system also includes a pair of hydraulic actuators 36 interconnecting the base member 26 of bucket 24 to the movable member 28 to effect articulated movement of member 28 relative to member 26 between open and closed positions. Each of the hydraulic actuators 32, 34, and 36 are preferably in the form of linearly extendable/retractable hydraulic cylinders which are provided with conventional plumbing connections to provide hydraulic fluid under pressure thus effecting various loader functions as controlled by the operator.

A control system 40 according to the present invention is provided between the power source and the actuators 32, 34, and 36 for selectively controlling the loader functions. In the embodiment illustrated in FIG. 2, control system 40 is used to operate a valve assembly 41 mounted on the frame of the loader and including valves 42, 44, and 46. As is conventional, each valve 42, 44, and 46 includes a valve stem 48 which positions a spool valve (not shown) thereby regulating fluid through the respective valve. As shown, valve 42 controls operation of the lift actuators 32; valve 44 controls operation of the tilt actuators 34; while valve 46 controls operation of the clam shell actuators 36.

The control system 40 for operating the valve assembly 41 and thereby loader mechanism 20 includes a vertically elongated control lever 50 mounted to the frame of the loader by a mounting assembly 52. In the illustrated embodiment, the control lever 50 includes a vertically elongated member 54 defining a vertical axis 55. An upper end of the control lever 50 is positioned within the operator compartment 16 (FIG. 1) of the loader for convenient access by the operator. As shown, an operator handle assembly 56 is carried at a free end of the control lever 50 for facilitating one-handed control over the three functions of the loader mechanism. Toward one of its ends, the control lever 50 is connected to the mounting assembly 52 to allow for manipulation of the control lever 50 in first and second directions extending normal to each other.

The control system of the present invention further includes a first linkage assembly 58, a second linkage assembly 60, and a third linkage assembly 62 for translating movements of the control lever 50, and operator handle assembly 56 into positional movements for valves 42, 44, and 46, respectively. Notably, the linkage assemblies 58, 60, and 62 are configured and arranged relative to each other such that movements of the control lever 50 or manipulation of the operator handle assembly 56 can effect independent operation of one of the valves of valve assembly 41 while combined movements of the control lever 50 and operator handle assembly 56 can effect conjoint operation of two or more valves of the valve assembly 41 thereby effecting two or more loader operations simultaneously relative to each other.

Figure 2:
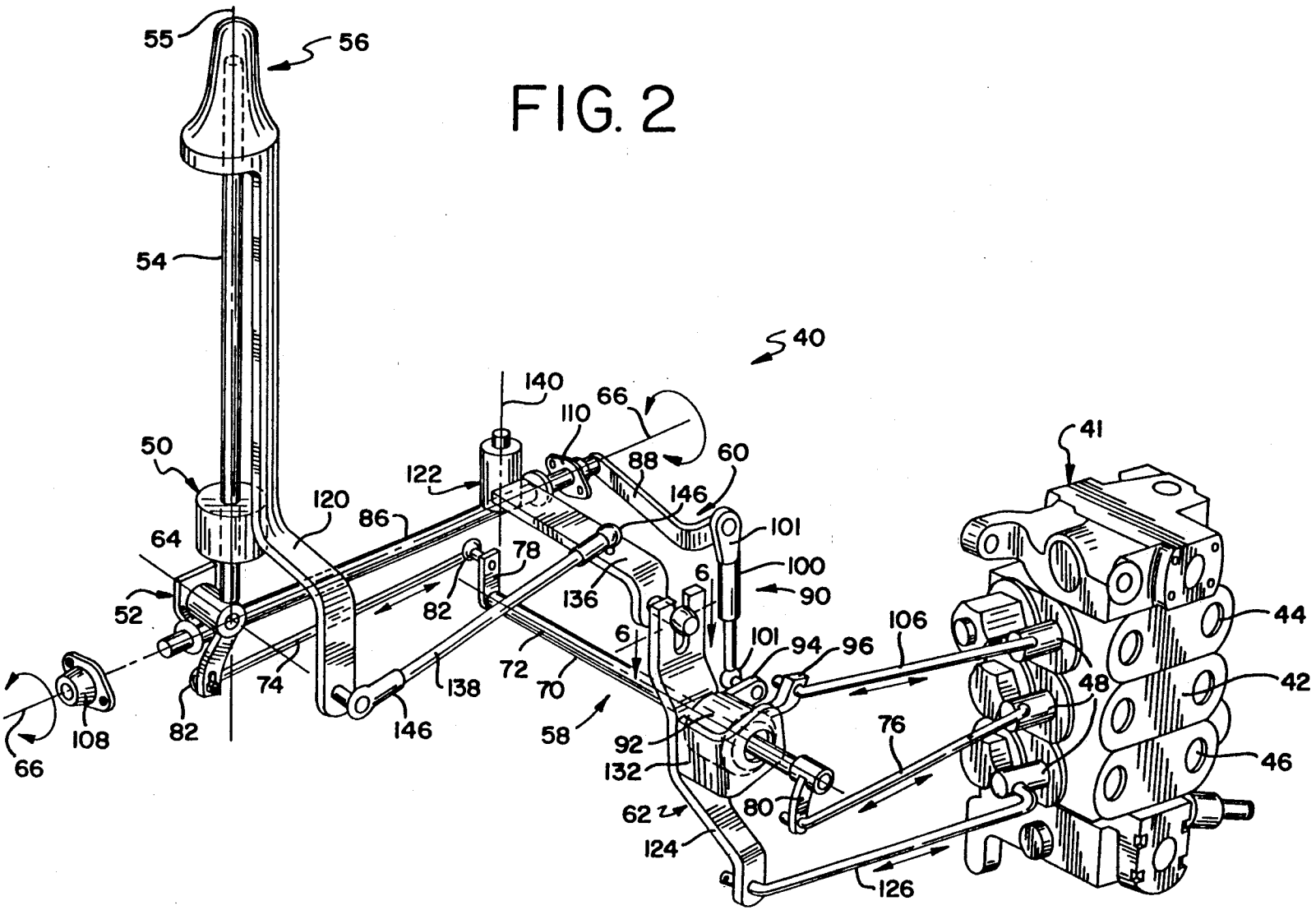
FIG. 2 is a perspective view of a control system according to the present invention.

As shown in FIG. 2, and as will be discussed in detail below, the mounting assembly 52 mounts the control lever 50 for arcuate movement in opposite fore-and-aft directions away from a neutral position and in a control arc centered about a first pivot axis 64. The mounting assembly 52 likewise allows movement of the control lever 50 to opposite sides of a neutral position and in a second control arc centered about a second pivot axis 66.

The first linkage assembly 58 includes a rock shaft 70 mounted to the loader frame for oscillatory movement in either rotational direction about a fixed axis 72 which extends generally parallel to pivot axis 64. At one end, the rockshaft 70 is coupled to an actuator 74 which responds to movements of the control lever in fore-and-aft directions about axis 64. At its opposite end, rockshaft 70 is connected to valve stem 48 of valve 42 as through a link 76. Suitable radial crank arms 78 and 80 are provided at opposite ends of the rockshaft 70 such that manipulation of the control lever 50 through the first control arc effects movement of the actuator 74 resulting in arcuate displacement of the rockshaft 70 about axis 72 thus controlling the position of valve 42 and thereby the elevational adjustment of the bucket 24.

The first linkage means further includes ball joints 82 disposed between the actuator 74, the control lever 50, and the rockshaft 70 for facilitating substantially universal movement therebetween. It is important to note, however, that side-to-side movements of the control lever 50 about axis 66 does not result in movements of the rockshaft 70 about axis 72 and therefore does not result in positional movements for valve 42.

The second linkage assembly 60 includes an actuator 86 connected to the control lever 50 and a radial arm 88 connected to and radially extending from actuator 86. Actuator 86 and radial arm 88 oscillate about axis 66 in response to side-to-side movements of the control lever 50. The radial arm 88 of linkage assembly 60 is connected to valve stem 48 of valve 44 through a linkage 90.

Figure 4:
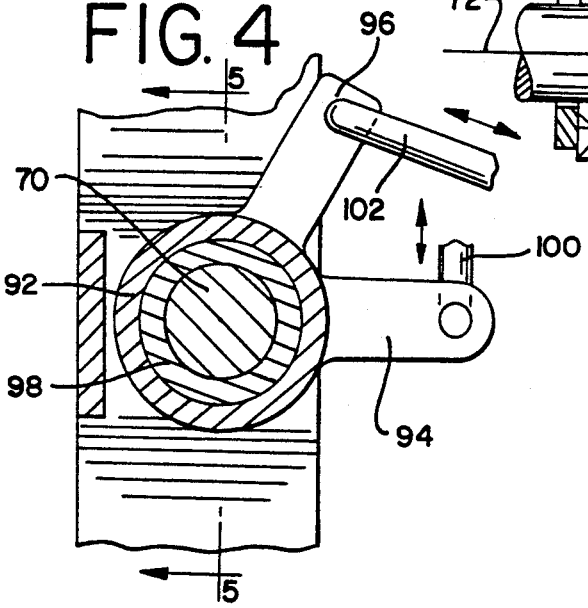
FIG. 4 is an enlarged fragmentary sectional view of another portion of the control system.

As shown in FIGS. 2 and 4, linkage 90 includes a force transfer link 92 including a pair of crank arms 94 and 96 radially extending therefrom. To facilitate assembly of the control system and to economize on the number of parts required, the force transfer link 92 is journalled on rockshaft 70 of the first linkage assembly for rotation about the common axis 72. A bushing or bearing 98 (FIG. 4) is preferably provided between the rockshaft 70 and the force transfer link 92 to facilitate rotation therebetween. The radial crank arms 94 and 96 are laterally offset from one another along the axis 72 of the force transfer link 92. Radial crank arm 94 is connected via linkage 100 to radial arm 88 extending from actuator 86. Suitable ball joints 101 on linkage 100 facilitate transfer motion and movements between control lever 50 and valve 44. Radial crank arm 96 is connected via linkage 106 to valve stem 48 of valve 44. As will be appreciated, side-to-side movements of the control lever 50 about axis 66 result in movement of the actuator 86 which ultimately is transferred into positional movements of valve 44 through arm 88 and linkage 90. Notably, fore-and-aft movements of the control lever 50 about axis 64 do not effect movement of the actuator 86 and therefore do not result in positional movements for valve 44.

In the illustrated embodiment, actuator 86 of the second linkage assembly 60 is configured as an elongated member or control rod adapted for oscillatory movements in opposite directions about a reference line axially aligned with and extending generally parallel to the second pivot axis 66 about which the control lever rotates. The control rod or actuator 86 is mounted for rotation between a pair of supports 108 and 110 mounted to the frame of the implement and which inhibit endwise movement of the control rod actuator 86 between the supports.

Figure 3:
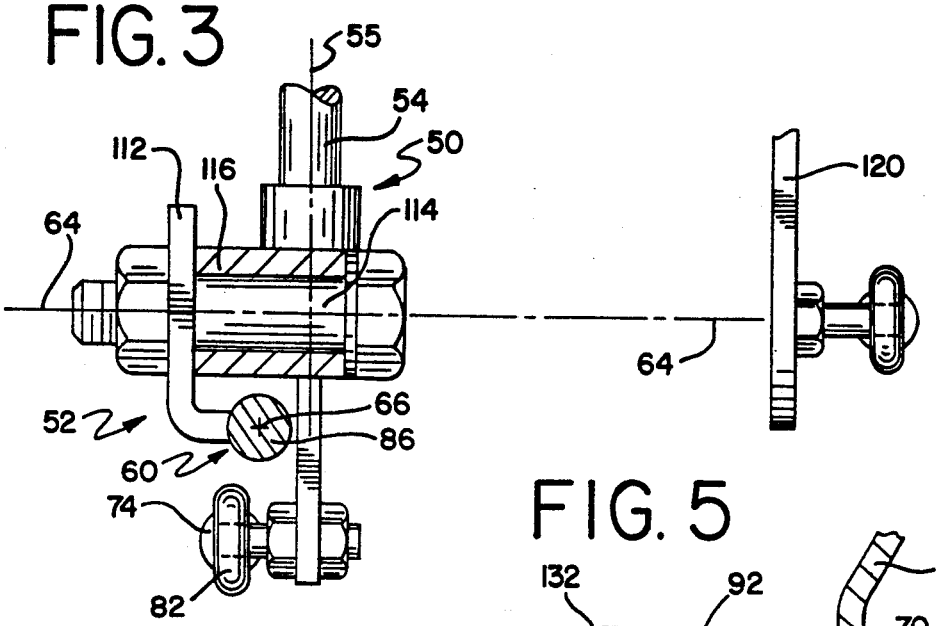
FIG. 3 is an enlarged fragmentary sectional view of a portion of the control system.

Returning to FIG. 3, the assembly 52 for mounting the control lever 50 includes a bracket 112 having a generally L-shaped configuration. One leg portion of bracket 112 is fixedly secured to and radially extends from the actuator 86 of linkage assembly 60. A shouldered bolt or other suitable pivotal member 114 extends from an opposite leg of bracket 112. The pivotal member 114 serves to pivotally secure a hub 116 of control lever 50 to the bracket 112 thereby allowing for fore-and-aft pivotal movement of the control lever 50 about axis 64 while allowing for side-to-side pivotal movement of the control lever 50 about the axis 66 defined by the actuator 86.

The third linkage assembly 62 includes an actuator 120 connected to the operator handle assembly 56. A force transfer mechanism 122 is likewise connected to the actuator 120 for translating twisting movements of the operator handle assembly 56 into positioning movements for the third valve 46. In the illustrated embodiment, actuator 120 moves in a fore-and-aft direction to opposite sides of a neutral position in response to twisting movements of the operator handle assembly 56 about the vertical axis 55 of control lever 50. Notably, however, linkage assembly 62 is arranged such that movements of the control lever 50 in first and/or second directions have substantially no effect on the force transfer mechanism 122 of the third linkage assembly 62 notwithstanding that the operator handle assembly 56 is carried at an upper end of the control lever 50. Thus, although the operator handle assembly 56 is intended to facilitate one-handed control of the control system, the operational functions controlled by the operator handle assembly 56 and the control lever 50 are separate and independent relative to each other unless the operator so desires to move the control lever assembly 50 concomitantly with the operator handle assembly 56 such that more than one function can be effected conjointly.

As shown in FIG. 2, the force transfer mechanism 122 of the third linkage assembly 62 preferably includes a bell crank lever 124 pivotally mounted on the frame of the loader. Lever 124 is interconnected via linkage 126 to valve stem 48 of valve 46. In a preferred form of the invention, and as shown in FIG. 5, the bell crank lever 124 is journalled intermediate its ends on rockshaft 70 of the first linkage assembly for rocking movements about axis 72.

Figure 5:
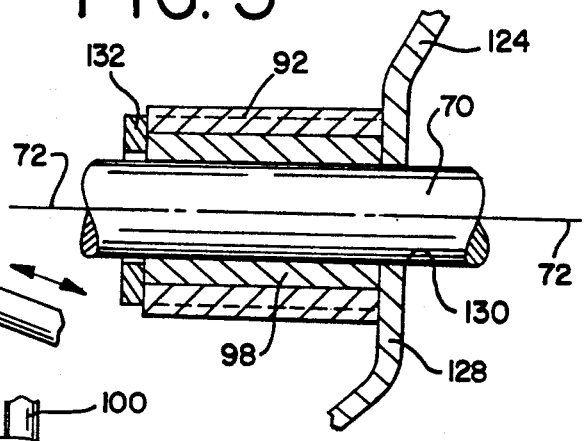
FIG. 5 is a sectional view taken along Line 5—5 of FIG. 4.

As shown in FIG. 5, lever 124 is provided with a central vertical wall portion 128 defining a bore 130 through which rockshaft 70 passes. Lever 124 is further provided with an L-shaped arm portion 132 which attaches to and projects away from the wall portion 128 of lever 124. In a most preferred form of the invention, the force transfer link 92 and bushing 98 of linkage 90 (FIG. 2) of the second linkage assembly 60 are entrapped for free rotation between arm 132 and the vertical wall portion 128 of lever 124. As will be appreciated, mounting the lever 124 for movement about rockshaft 70 eliminates unnecessary and redundant parts and thereby simplifies the invention.

Figure 6:
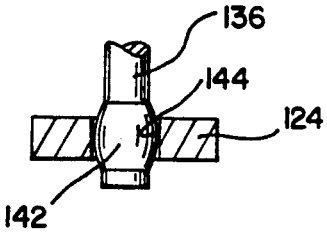
FIG. 6 is an enlarged fragmentary sectional view taken along Line 6—6 of FIG. 2.

Lever 124 of the force transfer mechanism 122 is oscillated about axis 72 through a pair of drivers 136 and 138 connected to actuator 120. In the illustrated embodiment, driver 136 is configured as a lever which is pivotally supported from loader frame for movement about a vertical axis 140. As schematically represented in FIG. 6, a free end of driver 136 includes a barrel-like roller 142 which is accommodated within an elongated vertical slot 144 defined at an upper end of lever 124. Driver 138 serves to translate movement of the actuator 120 into movement of driver 136. Suitable ball joints 146 are provided between actuator 120 and drivers 136 and 138 to facilitate transfer of motion therebetween while eliminating binding forces which would inhibit the transfer of motion therebetween. Upon movement of actuator 120 in response to twisting action of the operator handle assembly 56 about axis 55, the force transfer mechanism 122 is effective to positionally move valve stem 48 of valve 46 and thereby effect a third function for the loader mechanism.

Figure 7:
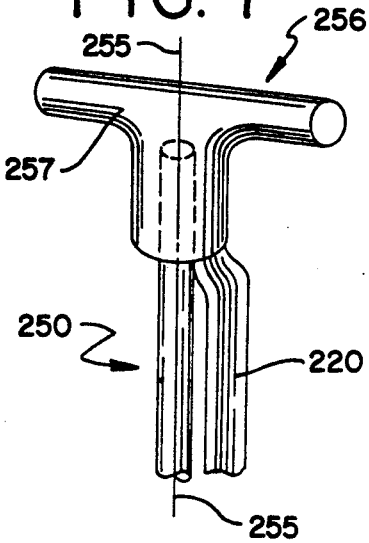
FIG. 7 schematically illustrates an alternative handle design for the control system.

In FIG. 7, there is shown an alternative embodiment of an operator handle assembly 256 mounted to a vertically elongated control lever 250 for twisting movements about vertical axis 255. The control lever 250 is in most respects identical to control lever 50 disclosed in FIG. 2. The operator handle assembly 256 includes a T-shaped operator handle 257 that has been designed to facilitate one-handed gripping thereof by the operator. The operator handle assembly 256 further includes an actuator 220 which is substantially identical to the actuator 120 disclosed in FIG. 2 for inducing movements to a force transfer mechanism such as 122 and which is suitable to position a valve of the valve assembly thereby controlling a function of the loader mechanism.

Figures 8, 9:
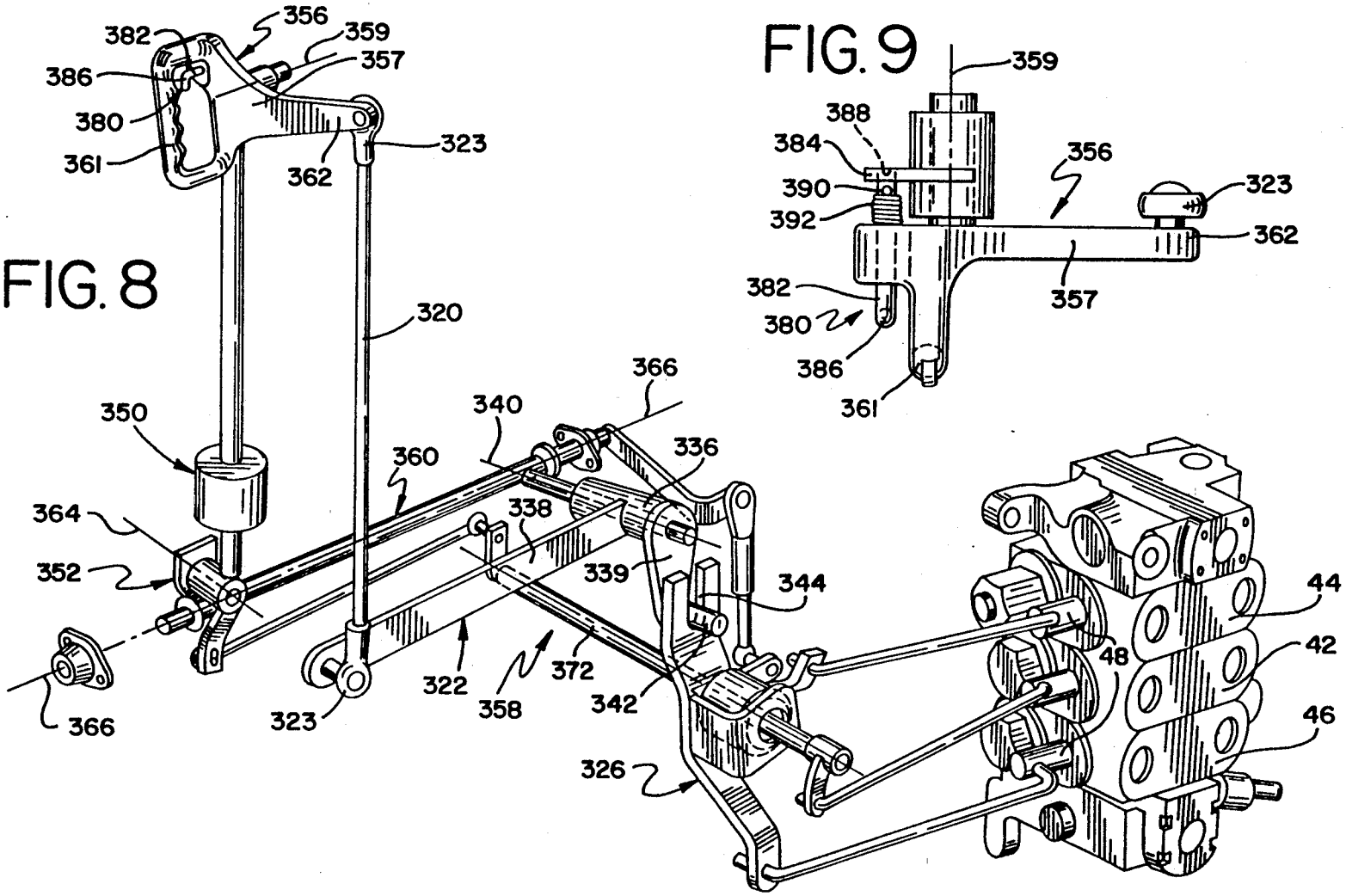
FIG. 8 is a perspective view of a second embodiment of a control system according to the present invention.
FIG. 9 is a top plan view of a handle assembly of the control system illustrated in FIG. 8.

FIG. 8 discloses another embodiment of a control system including a vertically elongated control lever 350 which is capable of one-handed control through an operator handle assembly 356. The control lever 350 is mounted to the frame of the loader as by a mounting assembly 352. The control lever 350 and mounting assembly 352 are substantially identical to the control lever 50 and mounting assembly 52 disclosed in FIGS. 2 and 3. Suffice it to say, the control lever 350 is adapted for arcuate movement through two control arcs centered about two axes 364 and 366 in response to induced rotation thereof from the operator handle assembly 356.

Movements of the control lever 350 through the two control arcs is translated into positional movements of the valve spools of valves 42 and 44 through linkage assemblies 358 and 360, respectively. Linkage assemblies 358 and 360 are substantially identical to the linkage assemblies 58 and 60 disclosed in FIG. 2 and discussed above.

The operator handle assembly 356 includes an operator handle 357 which is accessible to the operator in the cab region of the loader and is carried at the upper end of control lever 350 for twisting movements about a generally horizontal axis 359 extending generally parallel to axis 366. Handle 357 includes a grip portion 361 and an arm 362 extending radially away from axis 359.

In the embodiment of the invention illustrated in FIG. 8, an actuator 320, connected to the operator handle assembly 356, and a force transfer mechanism 322, connect the operator handle assembly 357 to the valve stem 48 of valve 46. In this embodiment of the invention, actuator 320 is connected to the free end of radial arm 362 of handle 357 and is adapted to move in a generally vertical path of movement in response to twisting movements of the operator handle 357 about the axis 359. Suitable ball joints 323 are interposed between actuator 320, the operator handle 357, and the force transfer mechanism 322 to facilitate transfer of motion and movements therebetween.

As shown in FIG. 8, the force transfer mechanism 322 is in most respects identical to the force transfer mechanism 122 disclosed in FIG. 2. In this alternative embodiment, the force transfer mechanism 322 includes a bell crank lever 336 mounted to the frame of the loader and adapted for pivotal movement about a generally horizontal axis 340 extending generally parallel to axis 364. The bell crank lever includes a pair of radial arms 338 and 339 which extend generally normal to each other and away from axis 340. A free end of the radial arm 338 is connected to the actuator 320. The free end of arm 339 includes a barrel-like roller 342 which is accommodated within a vertical slot 344 defined at an upper end of a bell crank lever 326. As shown, lever 326 is the equivalent of lever 126 disclosed in the embodiment illustrated in FIG. 2. As will be appreciated, the actuator 320 and force transfer mechanism 322 combine to translate twisting movements of the operator handle assembly 356 into positional movements of valve 46 thereby controlling the function of the loader regulated through valve 46.

Turning now to FIG. 9, the operator handle assembly 356 can be further configured to include a locking mechanism 380 for releasably securing the operator handle assembly 356 to the control lever 350 thereby inhibiting inadvertent movement of the handle 357 during manipulation of the control lever 350. In the illustrated embodiment, the locking mechanism 380 includes a releasable spring biased locking pin 382 carried by and movable with the operator handle 357 and an apertured flange 384 fixedly secured to and radially extending from an upper end of the control lever 350. In the illustrated embodiment, locking pin 382 is carried by the handle 357 for movement along a path extending generally parallel to axis 359 and is preferably configured with a grip portion 386 (FIG. 8) which can be readily engaged by the operator to release the locking mechanism. The opposite end of locking pin 382 is adapted to fit in an aperture 388 defined by flange 384. As shown in FIG. 9, locking pin 382 is furthermore provided with a radial extension 390 which extends beyond the outside diameter of the pin 382. Resilient means, preferably in the form of a compression spring 392, is entrapped between extension 390 and the handle 357 to normally urge the pin 382 into releasable locking engagement with flange 384 thereby preventing twisting movements of the handle 356 about axis 359.

During operation, the operator can manipulate the control lever by moving the operator handle assembly in several different directions to independently or conjointly control the three functions of the loader mechanism 20. While operation of the control system will be explained regarding the first embodiment of the invention, it should be appreciated that similar operations are carried out in a similar manner by the second embodiment of the invention. The control lever 50 may be moved in a fore-and-aft direction about an arc centered on axis 64. Movement of the control lever 50 about axis 64 is translated into pivot positional movements of valve stem 48 of valve 42 through the first linkage assembly 58. Movement of valve spool 48 of valve 42 controls the direction of flow of hydraulic fluid under pressure to the actuating cylinders 32 to effect raising and lowering of the loader arms 22.

Similarly, transferse or side-to-side movements of the control lever about axis 66 induces movement of valve stem 48 of valve 44 through the second linkage assembly 60. Of course, linear displacement of stem 48 of valve 44 controls the direction of flow of hydraulic fluid under pressure to the bucket tilt cylinders 34 to manipulate a pivotal movement of the bucket 24 relative to the loader arms.

Articulated movement of the clam member 28 relative to the base member 26 of bucket 24 is effected by effecting a twisting action of the operator handle assembly 56. Twisting movements of the operator handle assembly 56 are translated through the actuator means 120 associated therewith and the third linkage assembly 122 into positional movements of the valve stem 48 of valve 46, thus, controlling the direction of hydraulic fluid under pressure to the cylinder actuators 36 to effect pivotal movement of bucket member 28 relative to base member 26.

The mounting assembly 52 of the control system allows the control lever to be manipulated in four different directions each extending away from a neutral position so as to operatively control the elevation and pivotal functions of the loader mechanism and furthermore allows the operator handle assembly 56 to be twisted to control the articulated function of the bucket. A salient feature of the present invention being that the movements of the control lever 50 and movements of the operator handle assembly 56 can be affected such that each of the functions of the loader mechanism can be effected independently or conjointly relative to each other. That is, movement of the control lever 50 under the influence of the operator handle about axis 64 will not influence operation of the articulated movement of the bucket or tilting movements of the bucket. Similarly, when control lever 50 is moved to opposite sides of a neutral position and about axis 66, the articulated function and elevating function of the control system are not effected. Moveover, the operator handle assembly 56 can be twisted without having any effect on the elevational or tilting functions of the control system. Accordingly, all three functions of the loader mechanism, i.e. lift, tilt, and grab, can be accomplished through one-handed manipulation of the operator handle assembly which is conveniently accessible to the operator. Moreover, the operator handle assembly 56 can be manipulated to move the control lever to effect simultaneous operations of all three, or any combination thereof, so as to facilitate operation of the loader mechanisms through one-handed control.

Another feature of the present invention is that the operator handle assembly can be releasably locked in position relative to the control lever by the locking mechanism 380. Fingertip control of the locking mechanism 380 is provided to readily release the operator handle assembly and thereby facilitate three function control afforded by the control system of the present invention.

What is claimed is:

1. A three function control system for independently or conjointly controlling three different functions of a front end loader, said control mechanism comprising:

a vertically elongated control lever;

a control lever mounting arranged toward one of the ends of the lever for allowing said control lever to be manipulated through first and second control arcs centered about first and second pivot axes, respectively;

a first linkage assembly connected to the control lever for translating accurate movement of said control lever through said first control arc into a first loader function, said first linkage assembly including an actuator for moving fore-and-aft in response to manipulation of the control lever through the first control arc resulting in control of the first loader function, and for moving side-to-side in response to manipulation of the control lever through the second control arc, with the side-to-side movements of the actuator of the first linkage assembly having substantially no effect on the other two loader functions;

a second linkage assembly connected to the control lever for translating accurate movement of said control lever through said second control arc into a second loader function, said second linkage assembly including an elongated actuator supported for oscillation about a fixed axis in response to manipulation of the control lever through the second control arc resulting in control of the second loader function, said second linkage assembly having said control lever mounting carried thereon such that movement of the control lever through said second control arc imparts oscillatory movement to the elongated actuator of the second linkage assembly while movement of the control lever through said second control arc has substantially no effect on the actuation of the first linkage assembly and substantially no effect on a third loader function;

a handle assembly including a single handle carried at a free upper end of said conrol lever for moving said control lever through said first and second control arcs and mounted for manipulation through a twisting motion;

a third linkage assembly connected to the handle for translating twisting motion of said handle into a third loader function, said third linkage assembly including an actuator for moving a pair of levers in response to twisting movement of the handle resulting in control of the third loader function, with each lever of the third linkage assembly being movable about a separate axis, and with said actuator for the third linkage assembly moving with said handle as the control lever is moved through the first and second control arcs while imparting substantially no movement to said levers and thus substantially no effect relating to the third loader function; and wherein manipulation of the control lever through the first and second control arcs and twisting manipulation of the handle of the handle assembly allows for all three functions to be accomplished either independently or conjointly relative to each other through manipulation of the handle assembly carried by the control lever.

2. The three function control system according to claim 1 wherein the first linkage assembly includes a shaft disposed to pivot about an axis spaced from and parallel to the first pivot axis of said conrol lever, and with the actuator of the first linkage assembly extending between said shaft and the control lever such that manipulation of the control lever through the first control arc results in movement of the first linkage assembly actuator in a manner controlling the first loader function while movement of the control lever through the second control arc results in substantially no movement of the shaft and thereby has no effect on the first loader function.

3. The three function control system according to claim 2 wherein said first linkage assembly further includes ball joints disposed between the actuator, the control lever, and the shaft for facilitating substantially universal movement therebetween.

4. The three function control system according to claim 1 wherein the actuator of said second linkage assembly includes an elongated control rod mounted by a pair of supports which inhibit endwise movements of the control rod while allowing for oscillatory movements of the control rod about a reference line axially aligned with and extending generally parallel to the second pivot axis of said control lever, said control rod having a radial extension movable in response to manipulation of the control lever through the second control arc for controlling the second loader function while movement of the control lever through the first control arc results in substantially no movement of the extension and has no influence on the second loader function.

5. The three function control system according to claim 4 wherein said control lever mounting comprises a bracket assembly connected to the control rod for movement therewith and with said control lever being pivotally arranged thereon.

6. The three function control system according to claim 1 wherein one lever of said third linkage assembly comprises a bell crank lever disposed to pivot about an axis to control the third loader function.

7. The three function control system according to claim 1 wherein said handle of said handle assembly is readily accessible to the operator of the loader for twisting movements about a fixed axis which is aligned with the longitudinal axis of said control lever.

8. The three function control system according to claim 1 wherein said handle of said handle assembly is accessible to the operator of the loader and is mounted toward an upper end of said control lever for twisting movements in either rotational direction about an axis extending generally normal to the longitudinal axis of said control lever.

9. A three function control system for a loader having a wheeled frame, a loader mechanism supported from the frame and including a pair of loader arms pivotally attached to the frame at one end thereof for movement about a generally horizontal axis, a loader bucket pivotally attached to distal ends of the loader arms, said loader bucket being articulated for movement about an axis between an open and closed positions, a powered apparatus operably associated with the loader mechanism for effecting movement thereof, said powered apparatus including a hydraulic power source connected to first, second, and third hydraulic motors for controlling elevation of the bucket relative to the frame, pivotal movement of the bucket relative to the loader arms, and articulated bucket movement, said power source further including a valve assembly interposed between said hydraulic power source and each of said motors, said valve assembly including first, second and third valves for controlling operation of said first, second, and third motors, respectively, with each valve including a stem linearly movable in opposite directions from a predetermined position for influencing hydraulic flow to a respective motor as a function of the position of the stem relative to a respective valve, and with said control mechanism being arranged to independently or conjointly control actuation of the various valves of the valve assembly, said control mechanism.

a vertically elongated conrol lever connected toward a lower end to said loader frame for movement in first and second directions, with said second direction extending transverse to the first direction;

a first linkage assembly connected to and between said control lever and the stem of the first valve for positioning the first valve in response to movement of said control lever in the first direction, said first linkage assembly including an actuator movable in a first direction in response to movement of the control lever in the first direction thereby controlling the elevation on the bucket relative to the frame and for moving in a second direction extending general normal to the first direction in response to movement of the control lever in the second direction, with movement of the first linkage assembly actuator in the second direction having substantially no effect on either pivotal or articulated movements of the bucket;

a second linkage assembly connected to and between the control lever and the stem of the second valve for positioning the second valve in response to movement of said control lever in the second direction, said second linkage assembly including an elongated actuator supported for oscillatory movement about a fixed axis in response to movement of the control lever in the second direction thereby controlling pivotal movement of the bucket relative to the loader arms, said second linkage assembly being adapted to mount and connect said control lever to said loader frame such that movement of the control lever in the second direction imparts oscillatory movement to the elongated actuator of the second linkage assembly while movement of the control lever in the second direction has substantially no effect on either the elevation of the bucket relative to the frame or articulated bucket movement;

an operator accessible handle mounted toward an upper end of and for moving said control lever, said handle being mounted to the control lever for twisting movements; and a third linkage assembly connected to and between the handle and the stem of the third valve for positioning said third valve in response to twisting movements of said handle, said third linkage assembly including an actuator for moving a pair of levers of the third linkage assembly in response to twisting movement of the handle thereby controlling articulated bucket movement, said pair of levers of the third linkage assembly each being mounted for pivotal movement about a separate axis and with said third linkage assembly actuator moving with said handle as the control lever is moved in said first and second directions while imparting substantially no effect on either elevational or pivotal movements of the bucket; and wherein the various loader functions can be accomplished either independently or cojointly relative to each other through movements of the handle mounted on the control lever thereby facilitating single handed control over all three functions of the loader mechanism.

10. The three function control system according to claim 9 wherein said first linkage assembly includes a rockshaft mounted on the loader frame for movement in either rotational direction about a fixed axis and coupled between the first linkage assembly actuator and the stem of the first valve such that movement of the control lever in the first direction is translated into positional movements for said first valve through rotation of said rockshaft while movements of the conrol lever in the second direction have substantially no effect on movement of the rockshaft and thereby does not effect positioning of the first valve or elevation of the bucket relative to the loader frame.

11. The three function control system according to claim 10 wherein said second linkage assembly includes a rockshaft mounted on the loader frame and operably connected to the stem of the second valve such that movements of the control lever in the second direction are translated into positional movements for said second valve through rotation of the second linkage assembly rockshaft while movements of the control lever in the first direction have substantially no effect on the movement of the rockshaft of the second linkage assembly and thereby do not effect positioning of the second valve or the second loader function.

12. The three function control system according to claim 11 wherein said second linkage assembly further includes linkage for connecting the second linkage assembly rockshaft to the stem of the second valve, said second linkage assembly linkage including a transfer link pivotally mounted for rotation about the fixed axis of the first linkage assembly rockshaft.

13. The three function control system according to claim 10 wherein one lever of the third linkage assembly comprises a bell crank lever pivotally mounted for rotation about the fixed axis of the rockshaft of the first linkage assembly.

14. The three function control system according to claim 9 wherein said handle is contoured to fit the hand of the operator to facilitate twisting movements as well as movements of the control lever in the first and second directions, said handle further including a locking apparatus for releasably locking said handle to the control lever to inhibit inadvertent twisting movements of the handle.

* * * * *